US009266113B2

(12) United States Patent
Manola

(10) Patent No.: US 9,266,113 B2
(45) Date of Patent: Feb. 23, 2016

(54) BIOMASS CRUSHING AND SEPARATING DEVICE

(75) Inventor: Umberto Manola, Brescia (IT)

(73) Assignee: BIOHYST OVERSEAS SAGL, Lugano (CH)

( * ) Notice: Subject to any disclaimer, the term of this patent is extended or adjusted under 35 U.S.C. 154(b) by 914 days.

(21) Appl. No.: 13/510,118

(22) PCT Filed: Nov. 16, 2010

(86) PCT No.: PCT/IB2010/002924

§ 371 (c)(1),
(2), (4) Date: Jul. 25, 2012

(87) PCT Pub. No.: WO2011/061595

PCT Pub. Date: May 26, 2011

(65) Prior Publication Data

US 2012/0280071 A1 Nov. 8, 2012

(30) Foreign Application Priority Data

Nov. 17, 2009 (EP) ..... 09014344

(51) Int. Cl.

| | |
|---|---|
| ***B02C 19/00*** | (2006.01) |
| ***B02C 23/12*** | (2006.01) |
| ***B07B 7/083*** | (2006.01) |
| *B07B 7/00* | (2006.01) |
| *B04C 9/00* | (2006.01) |
| *B04C 5/08* | (2006.01) |

(52) U.S. Cl.

CPC ..... *B02C 19/005* (2013.01); *B02C 19/0025* (2013.01); *B02C 23/12* (2013.01); *B07B 7/083* (2013.01); *B04C 5/08* (2013.01); *B04C 9/00* (2013.01); *B07B 7/00* (2013.01)

(58) Field of Classification Search

CPC .. B02C 19/005; B02C 19/0025; B02C 23/12; B07B 7/083; B07B 7/00; B04C 5/08; B04C 9/00

USPC ..... 241/62, 152.1, 152.2, 153, 275; 209/713, 715, 717, 732

See application file for complete search history.

(56) References Cited

U.S. PATENT DOCUMENTS

| | | | | |
|---|---|---|---|---|
| 2,644,740 | A * | 7/1953 | Dodds et al. | 43/138 |
| 2,919,864 | A | 1/1960 | Parmele | |
| 3,995,784 | A * | 12/1976 | de los Santos Izquierdo | 241/275 |

(Continued)

FOREIGN PATENT DOCUMENTS

| | | |
|---|---|---|
| DE | 821312 | 11/1951 |
| EP | 0282950 | 9/1988 |

(Continued)

*Primary Examiner* — Alexander P Taousakis
*Assistant Examiner* — Leonel Vasquez
(74) *Attorney, Agent, or Firm* — Pearne & Gordon LLP

(57) ABSTRACT

Micrometric separator (1) for biomasses (100) in particles, of the type including a first crushing stage (2) wherein particles are introduced dispersed in a conveying fluid bed, and a first conveyor for conveying the particles in the fluid bed. The first crushing stage (2) has a first crushing chamber (5) for reciprocal collisions of particles, that has a first revolving disc (7) provided with first members (9) for generating a turbulent flow in the fluid bed, and a first contrast body (8), in front of the first revolving disc (7), as well as one or more outlets (22) of the fluid bed, the first contrast body (8) being provided with an inlet (6) having an inflow section with the axis substantially incident to the first revolving disc (7).

17 Claims, 4 Drawing Sheets

(56) References Cited

U.S. PATENT DOCUMENTS

| | | | | |
|---|---|---|---|---|
| 4,133,487 | A * | 1/1979 | Lanier | 241/5 |
| 4,734,960 | A | 4/1988 | Bougard | |
| 7,651,044 | B2 | 1/2010 | Manola | |
| 8,322,637 | B2 * | 12/2012 | Nur et al. | 241/5 |
| 2002/0117564 | A1 | 8/2002 | Hahn et al. | |
| 2004/0108256 | A1 | 6/2004 | Hoffmann | |
| 2004/0238415 | A1 | 12/2004 | Chen et al. | |
| 2006/0231654 | A1 | 10/2006 | Manola | |
| 2010/0068196 | A1 | 3/2010 | Nur et al. | |

FOREIGN PATENT DOCUMENTS

| | | |
|---|---|---|
| EP | 1712286 | 10/2006 |
| GB | 812292 | 4/1959 |
| WO | 0012217 | 3/2000 |
| WO | 2008053475 | 5/2008 |

* cited by examiner

BIOMASS CRUSHING AND SEPARATING DEVICE

FIELD OF THE INVENTION

The present invention concerns with a micrometric separator for biomasses, having the main function of crushing such biomasses, and subsequently selecting (screening) the so-crushed particles, with the object of obtaining organic matrixes provided with different active ingredients, for example provided with different protein content, reciprocally separated.

BACKGROUND ART

It is known art to realize separators of the afore mentioned type wherein a specific mechanical device acts, because of compressing actions, or because of friction, or more because of collision, in such a way that the interaction between conveniently shaped parts of such a device and the biomasses in process would allow the mechanical crushing of said biomasses introduced inside the device. Further separating devices, for example of the cyclonic type, are then placed downstream to allow the selection of the previously crushed particles.

For example, the European Application EP-A-1712286 in the name of MANOLA teaches about the use of shaped rollers rotatable around their own axis and around a central cylinder that during the rotation, because of collision and eventually compression, would crush the biomasses, particularly composed of organic dry materials, thanks to the interaction of the biomasses themselves with the shaped revolving rollers and the central cylinder.

Such a device, particularly effective in extracting organic matrixes from the dry biomasses (for example hazelnut shells, or woody fibers), however exhibits the disadvantage that, in case wherein matrixes with protein content are destined to be extracted from the organic material easily to degrade, the contact of the biomasses with the crushing surfaces of rollers and the cylinder may cause the modification of the active ingredients of the organic matrixes that are intended to be extracted.

It is further known, for example in the US Application US-A-2002/0117564 in the name of HANH et al., how to realize micrometric separators wherein the material to be crushed, not necessarily composed of biomasses, is conveyed in a fluid bed that is alternatively subjected, inside a proper chamber, to high increases and decreases of pressure, for example obtained by servo-controlled rotors being able to generate pressure waves, so to cause the crush of the material conveyed by the fluid because of resonance.

These equipments, although efficient for crushing hard materials, are difficult to regulate for crushing biomasses to the end of obtaining selected matrixes containing convenient active ingredients, and they are further technically complex and expensive.

According to another technique, for example known from the International Patent Application WO 2008/053475, the biomass crushing for extracting organic matrixes containing active ingredients is carried out by an apparatus that is able to generate vortex motions inside an air flow wherein the biomasses are dispersed in particles. Such vortex motions may be generated in a cylindrical chamber, introducing tangential fluidic flows with high pressures and predefined flow rates. Such an apparatus does not prevent particles of the introduced biomasses from colliding against the walls of the cylindrical receptacle, or even from remaining in contact with such walls, during their processing, with a possible consequent modification of the active ingredients contained in the organic matrixes to be extracted.

It is an object of the present invention to realize an apparatus for micrometric separation of biomasses in particles not presenting the drawbacks of the known art before complained.

It is then an object of the present invention to provide a micrometric separator for biomasses allowing an efficient crushing of biomasses, and a corresponding subsequent selection, being able to provide organic matrixes containing active ingredients, for example proteins, extremely pure.

Another object of the present invention is to realize a micrometric separator for biomasses allowing to obtain extremely high yields.

A further object of the present invention is to provide a micrometric separator for biomasses being compact and technically easy to produce.

SUMMARY OF THE INVENTION

These and other objects are obtained by the micrometric separator for biomasses according to the first independent claim and the following dependent claims. The micrometric separator for biomasses in particles, according to the present invention, comprises at least one first crushing stage wherein the particles of biomasses are introduced dispersed in a conveying fluid bed (conveying fluid current), and first means for conveying particles through the aforesaid fluid bed. Such a first crushing stage comprises a first crushing chamber for reciprocal collisions of particles having a first revolving disc provided with first members for generating at least one turbulent flow in the fluid bed, for example composed of cylindrical bodies projecting from the revolving disc into the first crushing chamber, and at least one first contrast body, facing the first revolving disc, as well as one or more outlet of the fluid bed. The afore said first contrast body is further provided with at least one first inlet with an inflow section having its axis substantially incident to the plane the afore said revolving disc lies.

It has to be noticed that with the term "revolving disc" it is herein and after intended any revolving body having two dimensions prevailing the third, that could have a plan with any geometrical irregular or regular shape. Preferably, but not exclusively, such a revolving disc may have the shape, in plan, of a circle. According to a further aspect of the present invention, the micrometric separator is provided as well with a second crushing stage, placed downstream the aforesaid first stage, and fluidically connected thereto, that comprises a second crushing chamber for reciprocal collisions of particles having at least one second revolving disc provided with second members for generating at least one turbulent flow in the fluid bed, for example composed of branched grooves having different transversal section obtained on the second revolving disc, as well as at least one second contrast body, facing such a second rotating disc, and one or more outlets for the fluid bed. The second contrast body is provided as well of at least one second inlet having an inflow section with an axis substantially incident to the plane the second revolving disc lies.

As the Applicant could notice, the formation of vortex flows by merely the rotation of a disc provided with convenient members generating turbulences, for example projecting bodies or grooves, inside a chamber having dimensions chosen in relation with the particle dimension of the biomasses intended to be treated, would allow the biomasses to crush by reciprocal collisions without a significant contribution for crushing of possible biomass collisions against the walls of the device chamber, the contrast body or the disc, usually made of metal. That would allow, as aforesaid, to prevent the possible deterioration of the active ingredients contained in the crushed particles (organic matrixes) and then to increase the yield and quality of organic matrixes obtained at the process ending. According to a preferred aspect of the present invention, the afore said first and second stages are enclosed inside a receptacle provided with means for cooling the inner environment, for example comprising one or more air inlets for the entrance of the outer ambient air.

The cooling of the biomasses during their process has been found to be one of the characteristics mostly determining the high pureness of organic exiting matrixes and the high separator yield according to the present invention.

According to a further preferred aspect of the present invention, the micrometric separator comprises a third stage, placed downstream the first stage and/or the second stage, comprising at least one revolving body provided with means for generating a rotary and/or vortex flow in the fluid bed inside a corresponding case. Such a revolving body comprises as well a first outlet for selected particles of the afore said biomasses coming from the first or second stage, the aforesaid first means for conveying particles in a fluid bed conveying said particles from said first stage, or from said second stage, to said further stage and conveying said selected particles exiting from said first outlet as well. Preferably, the aforesaid means for generating a rotary and/or vortex flow comprise a plurality of fins projecting from the afore said revolving body.

BRIEF DESCRIPTION OF THE DRAWINGS

To better comprise the present invention, it will be now herein described, for purposes of illustrations and not limitative, a preferred embodiment of the present invention, referring to the attached figures, wherein.

DETAILED DESCRIPTION OF A PREFERRED EMBODIMENT OF THE INVENTION

Generally referring to the attached figures, the micrometric separator 1 according to the present invention is of the type adapted for the micrometric reduction and the subsequent final selection of biomasses, introduced in particles, with the object of obtaining organic matrixes having distinct organoleptic characteristics (and particularly proteinic characteristics).

Figure 1:
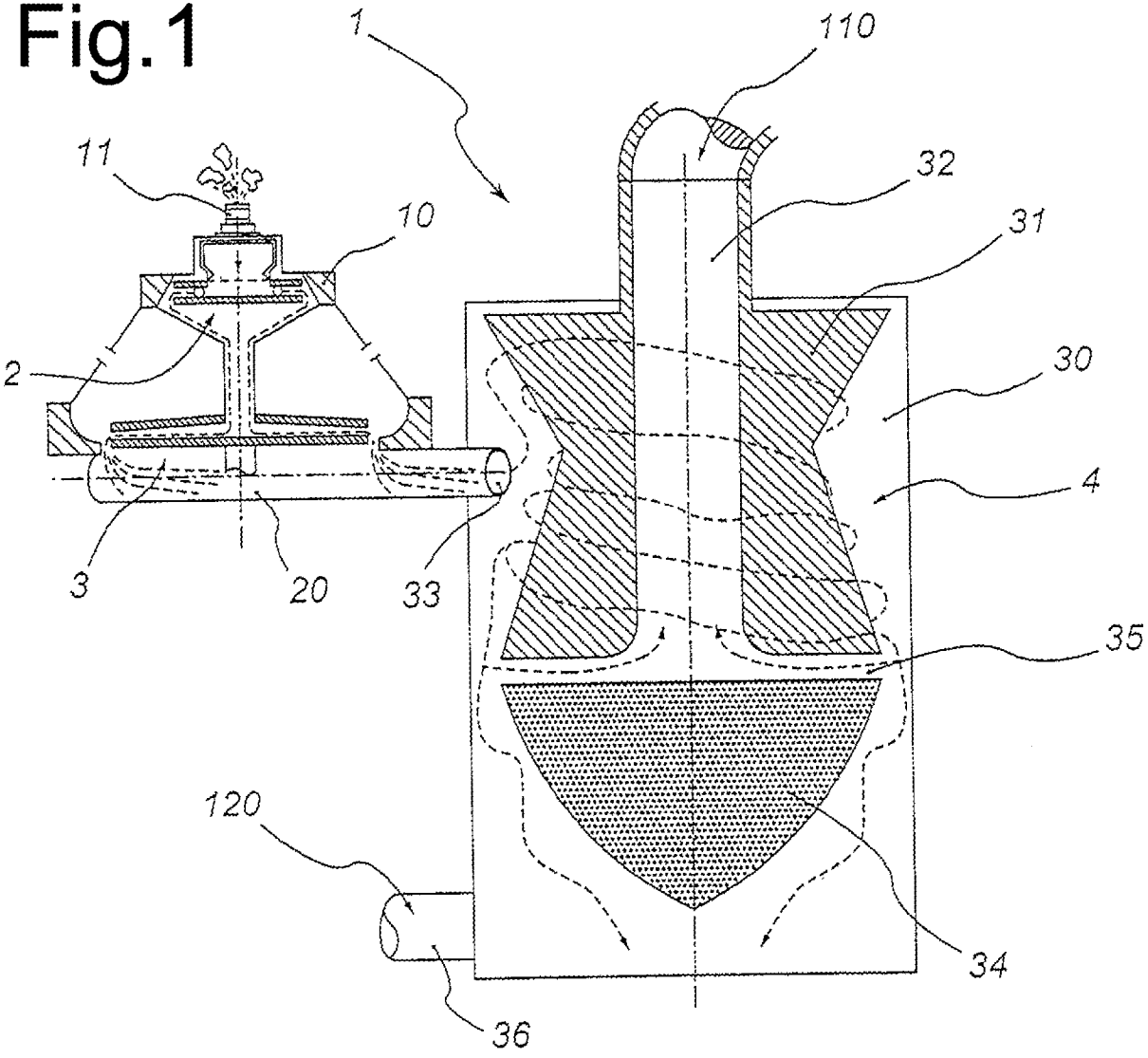
FIG. 1 is a sectioned schematic side view of a micrometric separator according to a particular aspect of the present invention.

As shown in FIG. 1, the micrometric separator 1, according to a particular aspect of the present invention, comprises crushing means of the multi-stage type, and selecting means for the crushed biomasses 100, as well as first means 110 for conveying in a fluid bed, for example and preferably composed of devices for generating a suction or throw air flow, and proper ducts joining the different stages of the separator 1.

It has to be noticed that such means 110, that could alternatively use an inert gas as a conveying fluid, are shaped in such a way to generate a fluidic flow having such a flow rate and pressure to suspendedly hold the biomasses 100 introduced therein and to convey them along the various stages of the separator 1.

Figure 2:
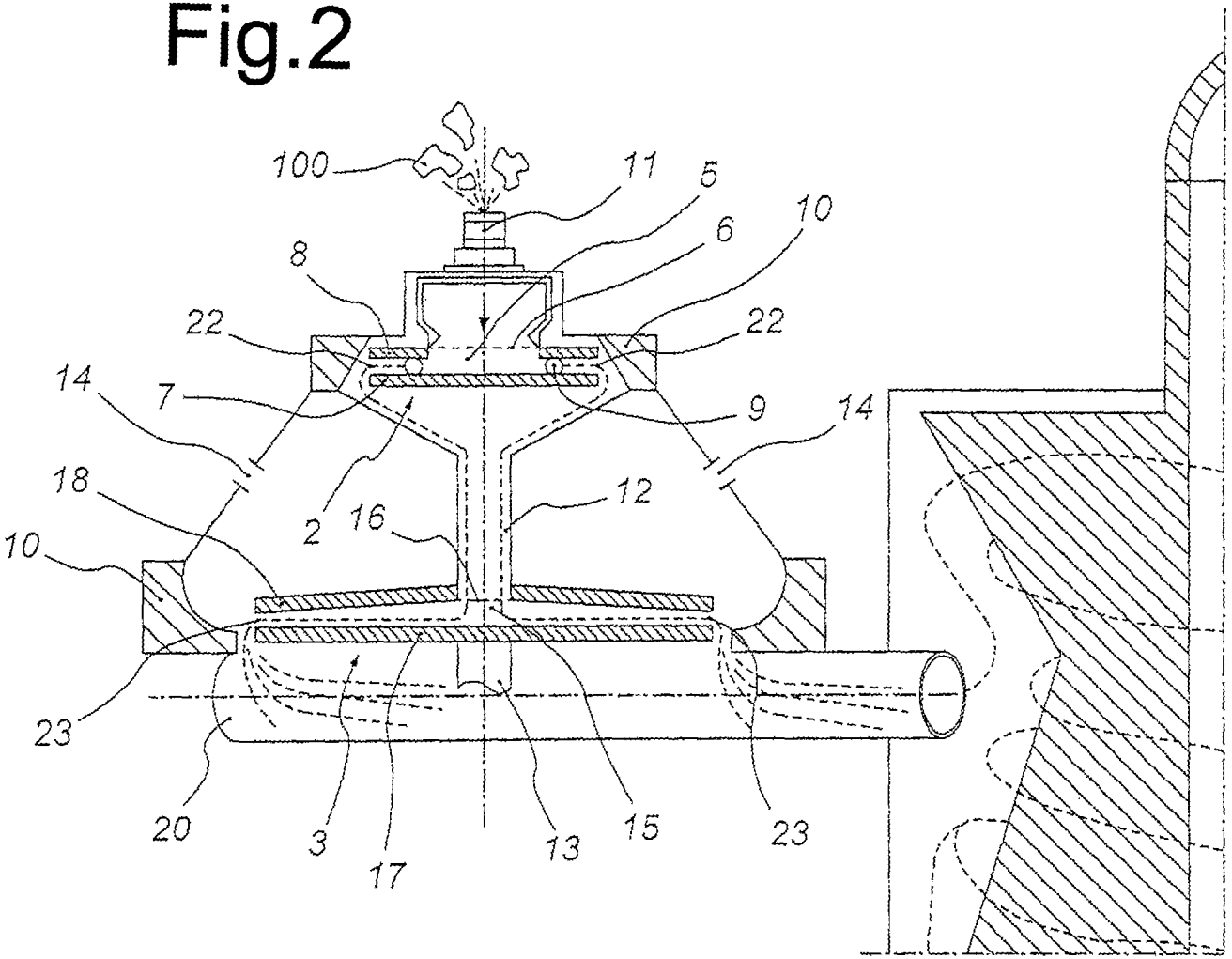
FIG. 2 is a sectioned schematic lateral view of the crushing stages in cascade of the separator illustrated in FIG. 1.
Figure 3:
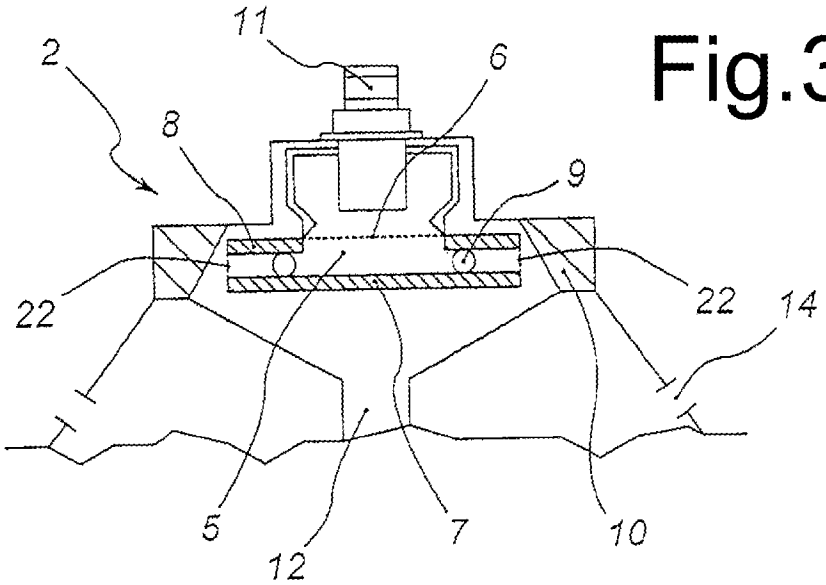
FIG. 3 is a sectioned schematic lateral view of the first crushing chamber of the separator in FIG. 1.
Figure 5:
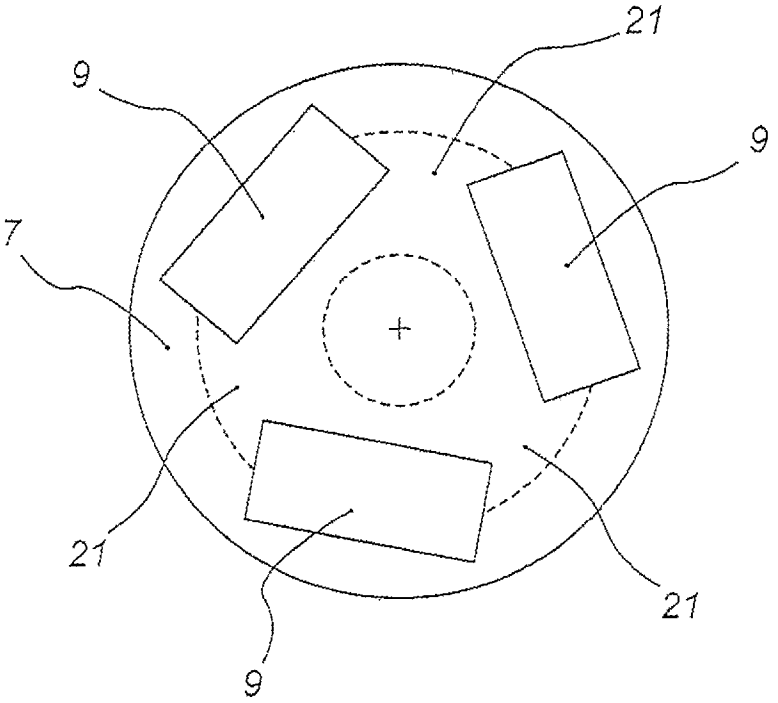
FIG. 5 is a top view of the internally faced surface inside the first crushing chamber of the separator of FIG. 1, of the first revolving disc.

Firstly referring to the crushing means as can be seen particularly in FIGS. 2, 3 and 5, according to a preferred embodiment of the present invention, these comprise at least one first crushing stage 2 composed of a first crushing chamber 5, contained in an appropriate case 10, wherein the biomasses are introduced from an entrance 11, they are subjected to a first crushing caused by the reciprocal collisions between the biomasses themselves, mainly provoked by the turbulences generated in the fluid bed and, after the crushing, they will flow out from the corresponding outflow openings 22.

It has to be observed that the crushing caused by reciprocal collision of biomasses 100 is a basic aspect of the crushing and selecting process of biomasses obtained by the separator 1 according to the present invention, because it has been observed that the crushing of biomasses 100 by compression, or friction or collisions, made by usually metallic extraneous surfaces of a machine, would not allow to obtain organic matrixes with organoleptic characteristics extremely pure or in sufficient amounts.

Such a first crushing chamber 5 of the separator 1 herein illustrated is defined by a first revolving disc 7, provided with projecting members 9 for generating a turbulent flow in the fluid bed conveying the biomasses 100, a corresponding contrast body 8, in front of the revolving disc 7, and provided with an inlet 6 for the fluid bed, as well as a plurality of outflow openings 22, substantially radial relatively to the disc 7, for the same fluid bed.

As mentioned yet, the chamber 5 is inserted inside a case 10, in the particular embodiment of the invention herein illustrated, the contrast body being fixed thereto. This latter has, in this embodiment, a cylindrical body shape with a circular section having the inlet 6, acting as an inlet for biomasses 100, in particles, into the same chamber 5.

The inlet 6 for the fluid bed into the first crushing chamber 5, as can be seen particularly in FIG. 2, is in fluidic communication with the afore said entrance 11 of the case 10, through a connecting chamber, and it is obtained in the contrast body 8 such that its passing section would have its axis incident, and preferably orthogonal, to the plane the revolving disc 7 is lain.

As can be seen particularly in FIGS. 3 and 5, the revolving disc 7 is composed of a metallic disc with a circular shape, lying on an horizontal plane and rotated by appropriate motor means (not shown) around its own vertical axis. Such a revolving disc 7 presents, along a circumference ideally represented on its surface inside the chamber 5, a plurality of projecting bodies 9, substantially cylindrical, extending into the chamber 5 towards the contrast body 8, almost up to lick the wall of the latter in front of the same disc 7. Between such cylindrical bodies 9 radial openings 21 are provided as well, inside which the fluid bed may in case flow out toward the afore said outflow openings 22.

It has to be noticed that, although herein it is described a revolving disc 7, having a horizontal development, and a fixed contrast body 8, any other arrangement and shape of such elements, as well as any other arrangement and shape of the chamber 5 and the outlets and inlets of the latter, would fall in the protection scope herein demanded, as long as the revolving disc 7, the contrast body 8 and the chamber 5 are according to the first independent attached claim, so that to generate appropriate turbulences in the conveying fluid of biomasses 100, being able to produce a crush because of mutual collision of the biomasses 100 themselves.

For example, in the alternative embodiments of the present invention herein not shown, the contrast body 8 may be composed of a disc, or other revolving element, the disc 7, such as the body 8, may lie on a tilted plane not being horizontal, as well as further inlets for the fluid bed into the chamber 5 may be provided.

Similarly, as it will be seen below, the members 9 for generating turbulences may be chosen not only from projecting cylindrical bodies, but may composed as well of radial, transversal or circumferential grooves, fins, ribs, etc., and these may be present not only over the revolving disc 7, but on the contrast body 8 too.

Again, the first crushing stage 2 may comprise more revolving discs inside the crushing chamber 5 and the contrast body 8 may adopt any proper shape to assure the opportune turbulence generation inside the chamber 5 itself.

Figure 4:
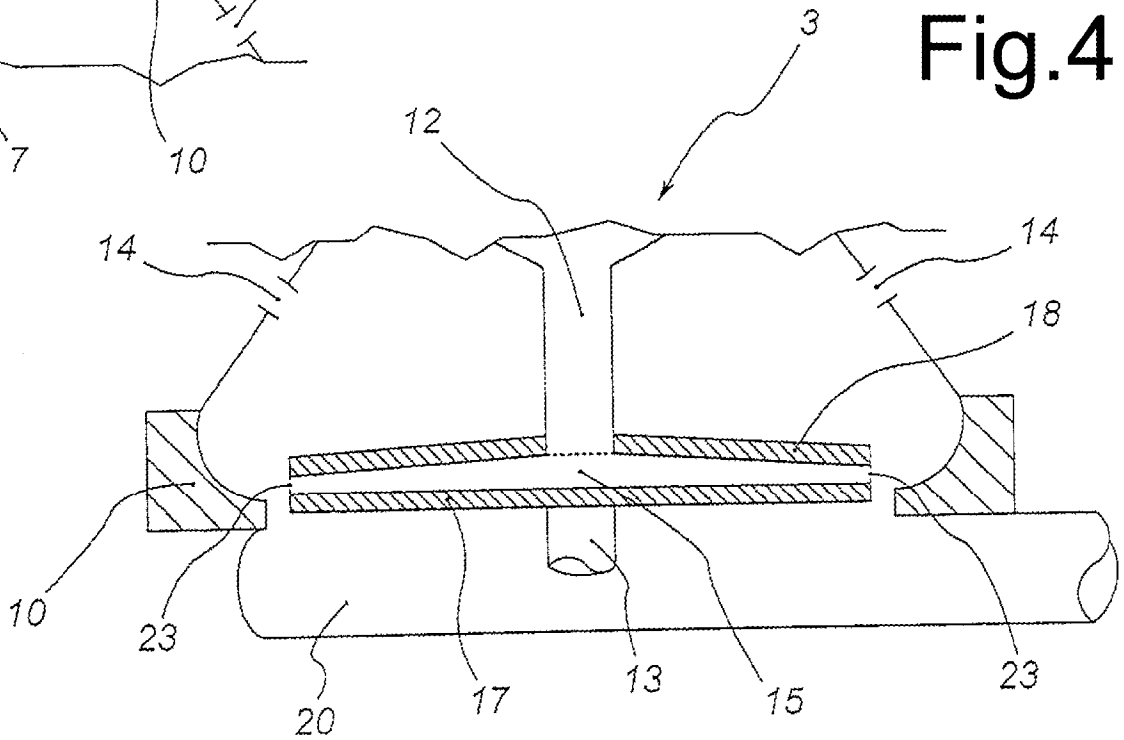
FIG. 4 is a sectioned schematic lateral view of the second crushing chamber of the separator in FIG. 1.
Figure 6:
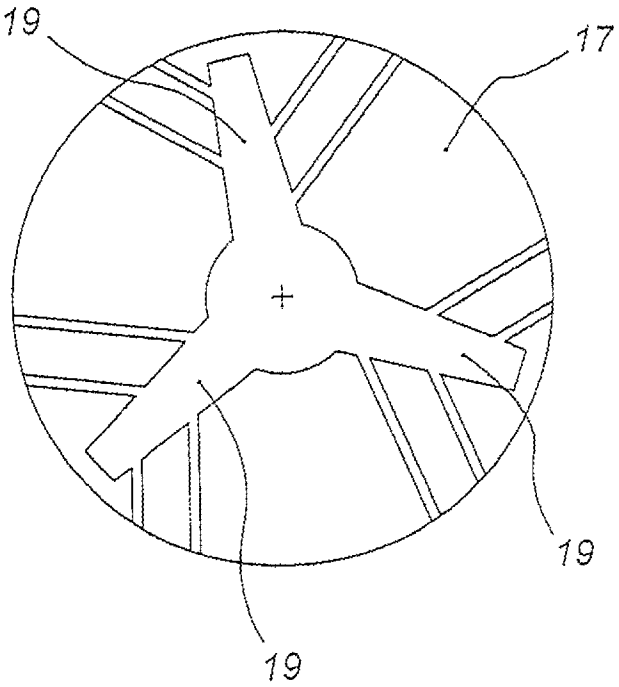
FIG. 6 is a top view of the internally faced surface inside the second crushing chamber of the separator of FIG. 1, of the second revolving disc.

According to a preferred embodiment of the present invention, particularly referring to FIGS. 4 and 6, after the first crushing stage 2 afore described there is a second crushing stage 3, placed downstream relatively to the first stage, comprising, as the first crushing stage 2, a second crushing chamber 15, that is placed inside the afore said case 10, and that is provided with a second inlet 16 and a plurality of outflow openings 23, preferably radial, and it is further composed of a second contrast body 18 in front of a second revolving disc 17, in its turn comprising second members 19 for generating turbulences in the fluid bed passing through the chamber 15.

Such turbulences, as in the first crushing chamber 5, have the object to cause the particles of biomasses 100 to collide one each other for further crushes, minimizing the collisions of the same particles against the case wall 10 or against the faced surfaces of the disc 17 and the contrast body 18.

The second contrast body 18, that in the particular embodiment of this invention herein shown has the shape of a pierced disc with a truncated cone profile, exhibits the second inlet 16 for the inflow of biomasses 100 into the chamber 15, that has an inflow section with axis incident, and particularly substantially orthogonal, to the horizontal plane on which the second revolving disc 17 lies.

Such a second inlet 16 for the biomasses, as can be seen in FIG. 2, is fluidically connected to the outflow openings 22 of the first chamber 5 of the first crushing stage 2 by a duct 12 that, allowing the fluid bed passage wherein the biomasses 100 are present, acts as a collector for conveying the biomasses 100 themselves, initially crushed in the first chamber 5 and exiting from the openings 22, toward the second crushing chamber 15 of the second crushing stage 3.

The second revolving disc 17, composed of a metallic circular disc rotated by motor means 13 around its own vertical axis, comprises on its inner surface of the chamber 15, as mentioned, second members 19 for generating turbulences in the fluid bed, that are composed, in the particular embodiment herein illustrated, by a plurality of branched ducts, having reciprocal different dimensions and arrangement. It has to be noticed that the crossing section between them is generally different and that some ducts are radial, others are transversal, others are even blind, and finally other ducts are opened on the outer edge of the disc 17.

Preferably, as can be seen in FIG. 6, the branched ducts are mainly composed of radial ducts, with greater section, closed in one of their ends, the transversal ducts departing therefrom, having smaller section, opened at their ends placed at the outer edge of the disc 17.

Such branched ducts, according to a preferred aspect of the present invention, may further have (axial) depth greater than the axial distance between the faced surfaces of the second revolving disc 17 and the corresponding contrast body 18. As mentioned yet, in the embodiment of the present invention herein described, both the first crushing stage 2 and the second stage 3 are contained inside the same case 10, this latter comprising as well air inlets 14 for allowing the inflow and the outflow (eventually forced) of ambient air into the same case 10, with the object of cooling the apparatus and particularly the biomasses 100 crushing because of reciprocal collisions.

It has to be observed that any other cooling means for biomasses subjected to crushing may be equally used, without therefore falling out from the protection scope herein demanded. The biomass cooling 100 during their crushing mainly because of reciprocal collisions, has proved to be a critical element for obtaining the final organic matrixes having high pureness.

According to a particular aspect of the present invention, means for regulating the reciprocal distance of the first revolving disc 7 and the corresponding contrast body 8 and/or the second revolving disc 17 and the corresponding contrast body 18 may be present, although herein not shown, whereby modifying the dimensions of the corresponding crushing chambers 5 and 15. This would allow to easily adapt the first two crushing stages 2 and 3 of the separator, according to the present invention, to the particular type of biomasses 100 intended to be processed.

The biomasses crushed in the first two crushing stages 2 and 3 of the separator 1 herein illustrated, exiting from the outflow openings 23 of the chamber 15, conveyed by the afore said fluid bed, penetrate into a duct 20 joining the case 10 to a contrast case 30, having a vertical development, wherein a separating stage 4 of the separator 1 is accommodated.

Such a separating stage 4 comprises, in the contrast case 30, a revolving body 31 provided with means for generating a rotary and/or vortex flow (cyclonic) in the conveying fluid bed for biomasses 100, an opening 33 for the particles coming from the crushing stages 2 and 3 of the separator 1, and a first outlet 32, intended for the outflow of the particles selected into the same separating stage 4. Such a first outlet 32, preferably comprising a duct axially obtained inside the revolving body 31 (that is at its rotation axis) and opened at both its higher and lower bases, is connected, at the higher base of the revolving body 31, to the afore said first conveying means 110 by a fluid bed for the biomasses 100.

According to a preferred aspect of the present invention, the separating stage 4 of the separator 1 comprises as well an adjustable element 34 for partially blocking the first outlet 32, of biomasses 100, that forms means for selecting the dimensions of the outflow section of the first outlet 32, of the separating stage 4, and comprises as well a second outlet 36 for non-selected particles, obtained in the afore said contrast case 30, at its lower base. Such a second outlet 36 is fluidically connected to second conveying means 120 in a fluid bed of non-selected particles of biomasses 100, that may be designed, as later shown, in such a way to convey such non-selected particles of biomasses 100 arrived in such a second outlet 36 to the entrance 11 of the case 10 again, wherein the two crushing stages 2, 3 of the separator 1 are accommodated, and thus at the inlet 6 of the chamber 5 of the first crushing stage 2.

More particularly, in the specific embodiment of the separator 1 shown in FIG. 1, the contrast case 30 is a cylindrical case, or any way having an axial symmetry, wherein the afore said opening 33 is opened substantially tangentially, and wherein the body 31 is axially rotating along a vertical axis, having an axial symmetry too, and being shaped as two truncated cones joined by their minor bases. The afore said means for generating a rotary and/or vortex flow inside the case 30, of which the revolving body 31 is provided with, may be preferably composed of a plurality of fins or ribs (not shown) projecting in a transversal way relatively to the axis of the revolving body 31, from its outer surface.

The adjustable element 34, afore described, is composed, in the embodiment herein illustrated, of a semi-conical body 4, disposed in such a way to present its own base in front of the lower base of the revolving body 31, and the position thereof relatively to the revolving body 31 itself is adjustable, thanks to appropriate means herein not illustrated.

The semi-conical body determines, with the lower base of the revolving body 31, an entrance chamber 35, for the selected particles, fluidically joining with the first outlet, constituting the outlet for the particles of the selected biomasses 100. The regulation of the position of the semi-conical body obviously changes the dimensions of the entrance chamber 35 and then changes the fluid dynamic resistance offered by the circuit composed by the same chamber 35 and by the duct, with appreciable effects in the particle dimensions exiting from such a duct.

It means that, according to the regulation of the position of the semi-conical body it is possible in practice to obtain a simple regulation of the particle dimensions of biomasses 100 intended to reach the first outlet 32.

But it has to be observed that, without the semi-conical body too, the substantially cyclonic flow, given by the revolving body 31 to the particles of the biomasses 100 crushed in the crushing stages placed downstream, would act a selection of particles destined for evacuation through the first outlet 32 (thanks to conveying fluidic means 110) and those on the other hand intended to remain inside the contrast case 30 and to be evacuated, through the second outlet 36, by the second conveying fluidic means 120.

Therefore, the particles of biomasses 100, coming from the two crushing stages 2, 3 of the separator 1, are selected inside the separating stage 4 thanks to the revolving body 31, in such a way that the particles having fine dimensions (and then limited mass) are evacuated by the fluidic flow conveniently generated by means 110, from the first outlet 32, whereas the particles having rough dimensions (and greater mass) are instead collected inside the case 30 at the second outlet 36 from which, thanks to second conveying means 120, as afore mentioned, they may be introduced again into the first two crushing stages 2, 3 of the separator 1. As the person skilled in the art may deduce, the separator 1 may be provided as well with means—herein not illustrated—for regulating the flow rate and/or pressure and/or speed of the fluidic flow generated by the conveying fluidic means 110 for conveying in a fluid bed the biomasses 100, and second fluidic conveying means 120. Further, the separator 1 may also comprise means for regulating the rotation speed of discs 7, 17 and of the revolving body 31, preferably in a separated way one each other. The operation of the afore described separator is as follows.

The biomasses 100, conveniently conveyed in particles by a fluid bed generated by conveying fluidic means 110, in case with the involvement of second conveying means 120, pass through the entrance 11 of the case 10 and then, through the inlet 6, penetrate into chamber 5.

Then, the rotation of the disc 7 and of the corresponding cylindrical bodies 9 generates turbulent motions inside the conveying fluidic flow for the biomasses 100 that, in their turn, would cause the reciprocal collision of particles of biomasses 100 being present inside the same chamber 5.

The mutual collisions between particles of biomasses 100 are such to allow a first crushing thereof, without the need of any mechanical operation of friction, collision or compression on biomasses 100 by extraneous materials, as the walls of the separator 1.

The particles so crushed exit from the outflow openings 22 and, thanks to the fluidic flow, cross the duct 12 for entering into the second crushing chamber 15, through the aforesaid second inlet 16.

In this chamber 15 too, the rotation of the disc 17, provided with branched ducts 19, causes the turbulent flow generation aiding the reciprocal collisions of particles of biomasses 100 conveyed and fluidically supported inside the same chamber 15, which are further crushing themselves thanks to reciprocal collisions. It has to be noticed that, thanks to the ventilation air inlets 14, it is possible to cool the same biomasses 100 during their crushing by reciprocal collisions.

Hence, exiting through the outflow openings 23 of the second crushing chamber 15, the crushed particles are conveyed, through the tube 20 and the opening 33, inside the vertical case 30 of the separating stage 4.

The rotation of the revolving body 31, with the projecting transversal fins, causes the formation of vortex motions in the fluid bed of particles that, even if they could provoke further collisions between particles of the biomasses 100 themselves, have the main function of generating a cyclonic motion causing the lightest particles, with minor dimensions, to be evacuated, through the chamber 35, from the exit duct outwardly the third separating stage 4, whereas it causes the heaviest particles, having bigger dimensions, to fall down because of gravity towards the bottom of the contrast case 30, from which, thanks to second fluidic conveying means 120 and through the second outlet 36, they may be brought back into the first two crushing stages 2, 3, and then newly introduced into the entrance 11 of the case 10.

As the Applicant could verify, the crushing because of reciprocal collisions of biomasses 100, with their temperature controlling, leads to the selection of fine organic particles (matrixes) provided with organoleptic characteristics extremely pure.

The invention claimed is:

1. Micrometric separator for biomasses crushed into particles, comprising at least one first crushing stage wherein said particles are introduced dispersed in a conveying fluid bed, and first means for conveying particles in said fluid bed, wherein said at least one first crushing stage comprises a first crushing chamber for reciprocal collisions of particles having at least one first revolving disc provided with first members for generating at least one turbulent flow in said fluid bed, and at least one first contrast body, facing said at least one first revolving disc, as well as one or more outflow openings for the fluid bed, said first contrast body being provided with at least one inlet having an inflow section with its axis substantially incident to said at least one first revolving disc, said micrometric separator further comprising a separating stage placed downstream said first stage and having at least one revolving body provided with means for generating a rotary and/or vortex flow of said fluid bed inside a corresponding contrast case, said at least one revolving body having a first outlet for the selected particles of said biomasses, said first means for conveying particles in a fluid bed conveying said particles from said first stage to said separating stage and conveying said selected particles exiting from said first outlet, said revolving body being axially rotating along a vertical axis, having an axial symmetry too, and being shaped as two truncated cones joined by their minor bases.

2. Micrometric separator according to claim 1, wherein said first members for generating at least one turbulent flow comprise a plurality of projecting bodies from said at least one first revolving disc into said first chamber.

3. Micrometric separator according to claim 2, wherein said projecting bodies comprise substantially cylindrical bodies disposed on said at least one first revolving disc and extended substantially until they lick the faced wall of said first contrast body.

4. Micrometric separator according to claim 3, providing radial openings between said substantially cylindrical bodies.

5. Micrometric separator according to claim 1, comprising at least one second crushing stage, placed downstream said first stage, and fluidically connected thereto, wherein said at least one second crushing stage comprises one second crushing chamber for reciprocal collisions of particles, having at least one second revolving disc provided with second members for generating at least one turbulent flow in said fluid bed, and at least one second contrast body, facing said at least one second revolving disc, as well as one or more outflow openings of the fluid bed, said second contrast body being provided with at least one second inlet having the inflow section with its axis substantially incident to said at least one second revolving disc.

6. Micrometric separator according to claim 5, wherein said second members for generating at least one turbulent flow comprise a plurality of ducts obtained on the surface, inside said second chamber, of said at least one second revolving disc.

7. Micrometric separator according to claim 6, wherein said plurality of ducts comprises branched ducts having reciprocal different sections.

8. Micrometric separator according to claim 6, wherein the depth of at least part of said ducts is higher than the distance between said at least one second revolving disc and the surface in front of it of said at least one second contrast body.

9. Micrometric separator according to claim 1, wherein said first stage and/or said second stage for crushing are enclosed inside a receptacle provided with means for cooling the inner environment.

10. Micrometric separator according to claim 9, wherein said cooling means comprise one or more air inlets for the entrance of the outer ambient air.

11. Micrometric separator according to claim 1, wherein said at least one first revolving disc and/or said at least one second revolving disc are substantially horizontal with substantially vertical rotation axis passing through their relevant geometrical center.

12. Micrometric separator according to claim 1, wherein said at least one case comprises at least one second outlet for non-selected particles of said biomasses.

13. Micrometric separator according to claim 12, comprising second means for conveying particles in a fluid bed, said second means for conveying particles in a fluid bed connecting said at least one second outlet of said non-selected particles with said first inlet of said first stage.

14. Micrometric separator according to claim 1, comprising means for selecting the dimensions of the outflow section of said first outlet of the selected particles, obtained in said at least one revolving body.

15. Micrometric separator according to claim 14, wherein said means for selecting the dimensions of the outflow section of said first outlet of particles comprise at least one element for partially blocking said first outlet of the biomasses.

16. Micrometric separator according to claim 15, wherein said at least one element for partially blocking is constrained inside said contrast case in a position-adjustable way relatively to said first outlet for particles obtained in said at least one revolving body.

17. Micrometric separator according to claim 1, wherein said at least one revolving body has rotation axis that is substantially vertical.

* * * * *